United States Patent [19]

Mineck

[11] 4,154,781

[45] May 15, 1979

[54] LOW PROFILE HORIZONTAL POSITIONABLE CARBURETOR WITH SELF-ADJUSTING DOUBLE VENTURI

[75] Inventor: Fred Mineck, Phoenix, Ariz.

[73] Assignee: Warren F. B. Lindsley, Phoenix, Ariz. ; a part interest

[21] Appl. No.: 868,394

[22] Filed: Jan. 10, 1978

[51] Int. Cl.[2] ..... F02M 9/14

[52] U.S. Cl. ..... 261/44 A; 261/44 D; 261/50 A

[58] Field of Search ..... 261/44 A, 44 D, 50 A

[56] References Cited

U.S. PATENT DOCUMENTS

| | | | |
|---|---|---|---|
| 1,234,400 | 7/1917 | Schmid et al. | 261/44 D |
| 1,682,761 | 9/1928 | Linga | 261/44 D |
| 1,701,600 | 2/1929 | Yeo | 261/44 D |
| 1,934,240 | 11/1933 | Scott | 261/44 D |
| 2,718,388 | 9/1955 | McCurdy | 261/50 A |
| 3,149,185 | 9/1964 | Spranger | 261/44 D |
| 3,432,152 | 3/1969 | Sweeney | 261/50 A |
| 3,528,787 | 9/1970 | Hallberg | 261/50 A |
| 3,592,449 | 7/1971 | Elgohary | 261/50 A |
| 3,994,998 | 11/1976 | Mineck | 261/50 A |

FOREIGN PATENT DOCUMENTS

| | | | |
|---|---|---|---|
| 564475 | 11/1932 | Fed. Rep. of Germany | 261/44 D |
| 435768 | 9/1935 | United Kingdom | 261/50 A |

*Primary Examiner*—Tim R. Miles

*Attorney, Agent, or Firm*—Warren F. B. Lindsley

[57] ABSTRACT

An improved low profile horizontally arranged carburetor for an internal combustion engine employing self-adjusting double venturi with improved gas expansion for operating effectively over a wide range of operating conditions.

9 Claims, 6 Drawing Figures

LOW PROFILE HORIZONTAL POSITIONABLE CARBURETOR WITH SELF-ADJUSTING DOUBLE VENTURI

BACKGROUND OF THE INVENTION

One of the most important parts of an internal combustion engine is its carburetor. Unless the carburetor performs well the engine will not start reliably, will not run smoothly and deliver adequate power and good gasoline mileage, and will produce excessive atmospheric pollutants.

Because the proper operation of the carburetion system is so essential to total engine performance, much attention has been given in the past to carburetor design and over the years the carburetor has become a complex device.

The complexity of the modern carburetor is apparent when it is recognized that the typical carburetor system employs six separate systems, i.e., a float system for controlling the level of fuel in the bowl; a low speed or idling system to provide an adequate fuel supply when air intake is low; a high speed or cruising system to overcome fuel inertia during a sudden increase in power demand; a power system to provide adequate fuel under conditions of reduced vacuum resulting from the opening of the throttle; and a choke system for increasing the fuel-to-air ratio under starting or low temperature conditions.

In addition, there are anti-percolation vents, hot idle compensators, anti-dieseling solenoids, deceleration controls in most modern carburetors.

This multitude of special systems and features requires careful adjustment and maintenance and the many small ducts and valves are vulnerable to blockage and wear by dust and dirt finding their way through the air filter.

Furthermore, until recently there has been a greater emphasis on certain aspects of performance such as starting, acceleration and power developed with insufficient emphasis given to gasoline mileage and atmospheric polluting conditions.

Thus, a need exists for a new approach to carburetor design which will produce a better balance in total performance while utilizing a simpler design that does not require the numerous separate systems and special accessories and which provides in particular improved gas mileage and a lower level of atmospheric pollution.

DESCRIPTION OF THE PRIOR ART

British Pat. No. 435,768 issued Sept. 22, 1935 describes a simplified carburetor design utilizing a single self-adjusting venturi bearing similarities to the present invention but lacking certain features which are essential to the effective performance of the carburetor disclosed herein. The piston disclosed in the British patent does not have the proper contours essential to the promotion of turbulence as needed for the thorough mixing of fuel and air. Some of the critical moving parts with intimate bearing surfaces are exposed to contamination by the air passing through the carburetor and there is no provision for cleaning of these surfaces by the gasoline supply.

SUMMARY OF THE INVENTION

In accordance with the invention claimed, an improved and greatly simplified low profile horizontally positionable carburetor is provided which utilizes a completely different approach to meet the full range of operating requirements.

It is, therefore, one object of this invention to provide an improved low profile carburetor for an internal combustion engine which may be horizontally positioned for increasing gas expansion and air mixture over the known design.

Another object of this invention is to provide an improved low profile carburetor the top part of which is covered by the air filler thereby keeping the gasoline and bottom part of the carburetor relatively cool for better performance.

A further object of this invention is to provide an improved carburetor in which the number of moving parts is drastically reduced.

A still further object of this invention is to provide an improved carburetor the venturi action of which may be adjusted externally of the carburetor housing.

A still further object of this invention is to provide a fuel feed or injection carburetor in the fuel line which is fed into the carburetor above its needling jet that controls air fuel flow to the carburetor acting in conjunction with an O-ring to form a positive shut off of fuel to the carburetor when the engine stops running, thereby eliminating evaporation and the associated atmospheric pollution.

A still further object of this invention is to incorporate in the design of the carburetor a self-adjusting metering rod which insures a high speed stream for fuel and air mixing at all engine speeds.

A still further object of this invention is to provide a new and improved carburetor which eliminates the need for accelerating pumps, idle jets, automatic chokes, anti-percolation vents, anti-dieseling solenoids and the like.

A still further object of this invention is to provide an improved carburetor with effective fuel and air mixing capabilities yielding more finely divided fuel droplets than heretofore possible thoroughly dispersed in the air stream accomplished through the provision of an enlarged fuel supply area around the entrance to the metering rod for optimum performance at all engine speeds.

A still further object of this invention is to provide a carburetor in which all fuel mixing is accomplished ahead of the throttle plate, thereby realizing a more uniform distribution of fuel throughout the air body.

A still further object of this invention is to provide such a carburetor with a single and readily accessible vernier adjustment for optimizing its operation.

Yet another object of this invention is to locate such moving parts where they will be cleaned and lubricated by the gasoline passing through the carburetor.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
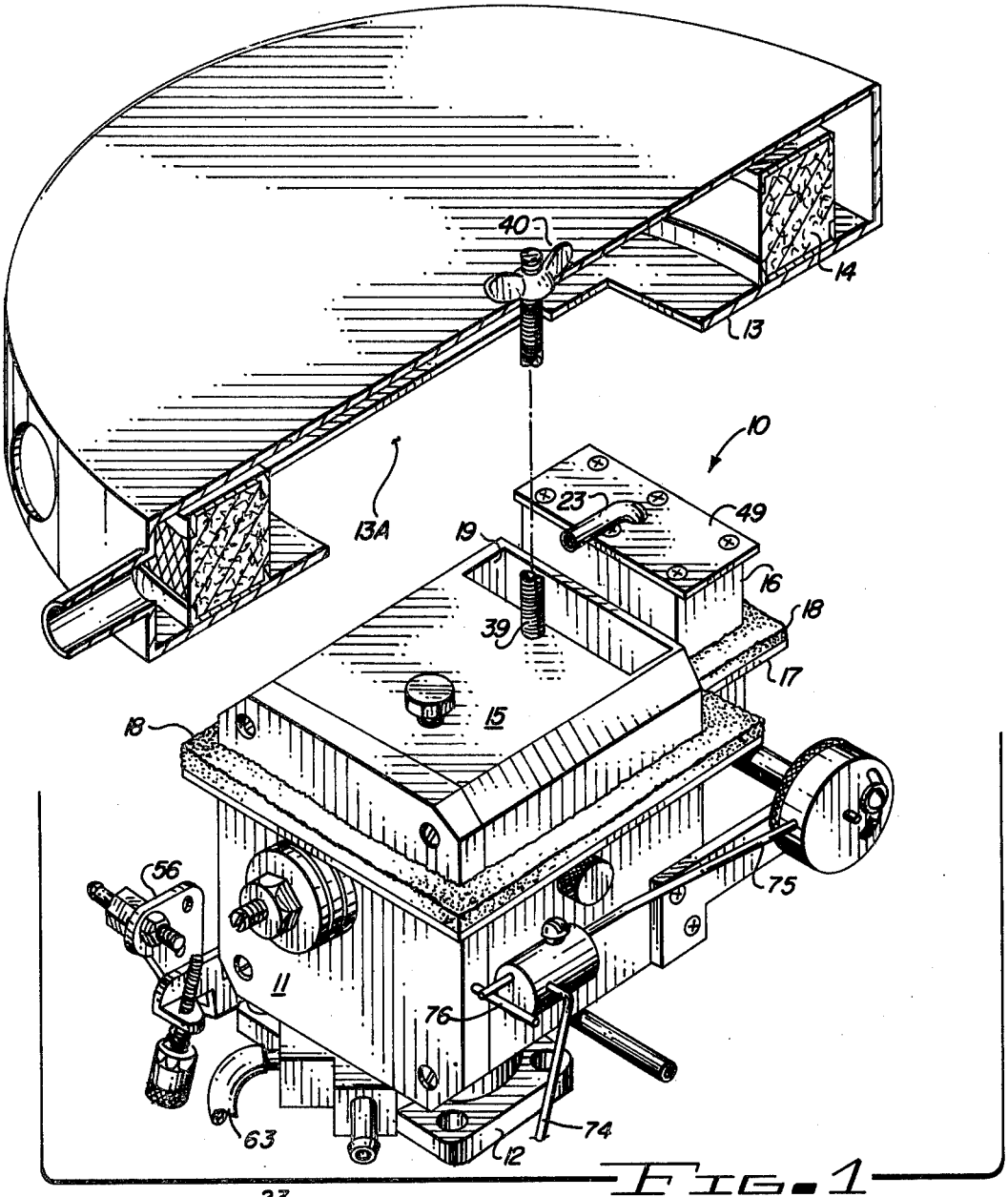
FIG. 1 is a perspective view of an improved carburetor embodying the invention with part of the air cleaner housing broken away and spaced therefrom to reveal its structural details.

Referring more particularly to the drawing by characters of reference, FIGS. 1–6 disclose an improved carburetor 10 comprising a carburetor housing 11 rigidly secured between a conventional throttle plate 12 at one end and an open-centered disc-shaped air filter housing 13 at its other end. The air filter plate 13 comprises a circular air filter 14, the opening of plate 13 together with the air filter fitting over and around the top surface 15 of the housing and a fuel reservoir 16 on a ledge 17 of housing 11. If desired, a suitable resilient or cork-like material 18 may be fitted on top of the ledge for forming an air tight seal when the air filter housing 13 is set thereon.

The carburetor housing comprises a hollow rectangular configuration having the fuel reservoir 16 mounted on top of ledge 17 with the air intake opening 19 formed in its top 15.

Reservoir 16 has the usual pivotally mounted float 20 which is mechanically associated with the known fuel metering valve 21 associated with a fuel inlet 22. A vent 23 provides atmospheric pressure within the reservoir, and fuel, such as gasoline, is caused to flow through a fuel line 24A into a hollow cylindrical passageway 24 in a flange 25 bolted to end 26 of housing 11.

Figure 5:
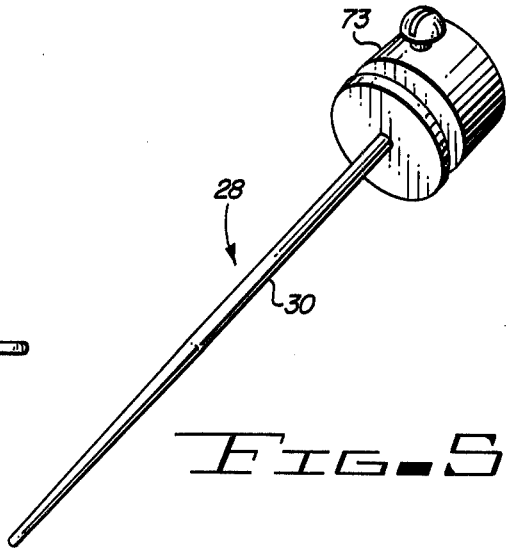
FIG. 5 is a perspective view of the metering rod of the assembly of FIG. 1.
Figure 4:
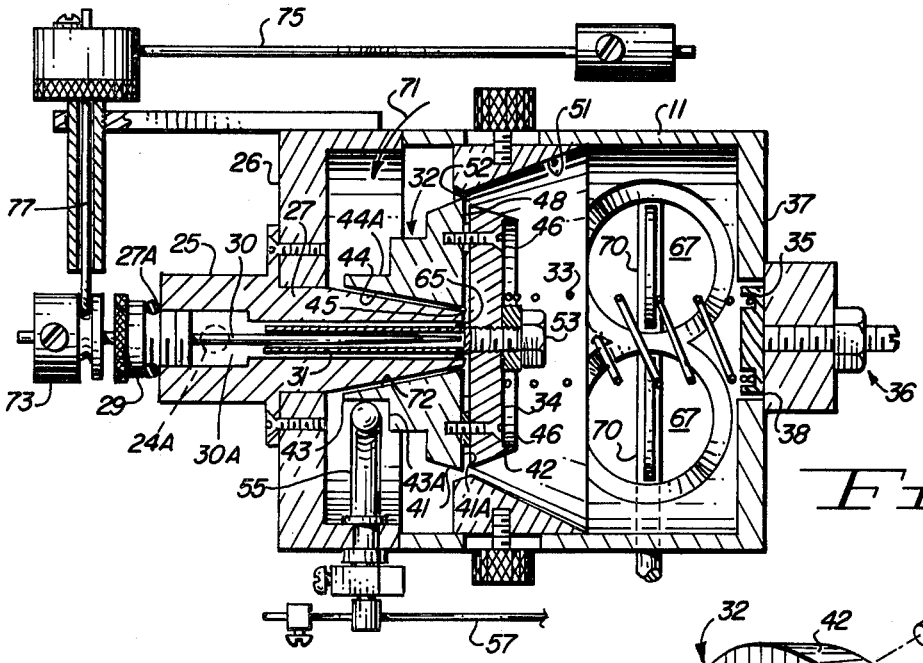
FIG. 4 is a sectional view of a part of the carburetor taken along line 4—4 of FIG. 2.
Figure 6:
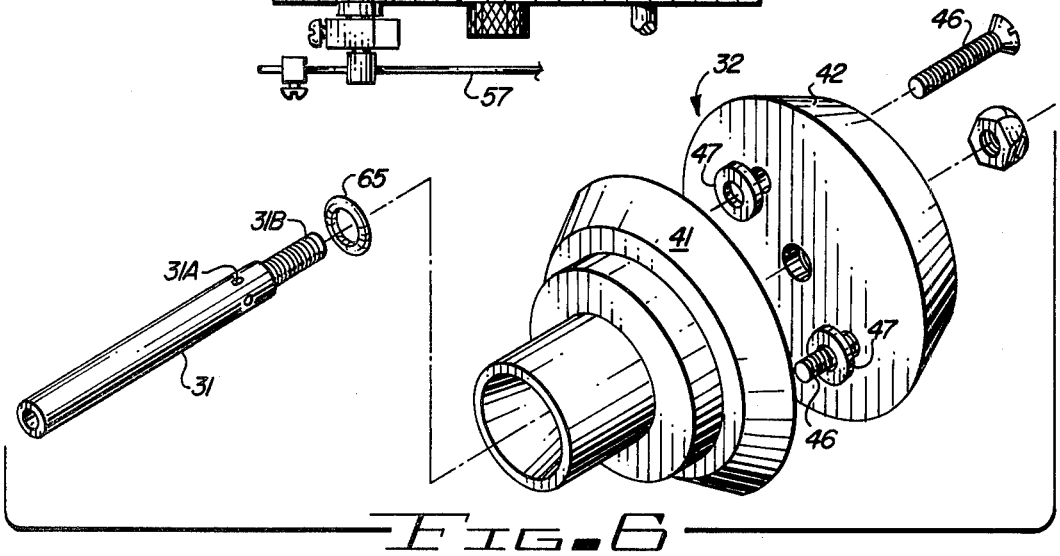
FIG. 6 is an exploded perspective view of the piston assembly shown in FIG. 4.

The flange 25 together with its conical nose configuration 27 form a fixed part of housing 11 to which a metering valve assembly 28, shown in FIGS. 4, 5 and 6, is adjustably attached by means of a knurled nut and O-ring assembly 29 so that a metering rod 30 of the metering valve assembly can be adjustably positioned within an orifice or metering column 31 extending longitudinally through the flange 26 and conical configuration 27. A venturi piston assembly 32, enveloping the lower end of the fuel-metering column 31 moves substantially horizontally within housing 11, as shown in FIG. 4, under the control of vacuum acting against a coil spring 33. The spring 33 operates between an indented surface 34 of piston assembly 32 and a U-shaped flange 35 threadedly attached by a nut and bolt assembly 36 to end 37 of housing 11 covering an opening 38 formed therein.

The air filter 14 is secured to the top 15 of housing 11 by a long vertically oriented machine screw 39 and nut 40. The fitting of the aperture 13A of the disc-shaped filter housing 13 around housing 11 and fuel reservoir 16 on ledge 17 centers and aligns the air filter on the carburetor structure.

Piston assembly 32, as shown most clearly in FIGS. 4 and 6, comprises a pair of piston members 41 and 42 arranged in the form of a conical section taken from a solid cone by means of two parallel cuts taken perpendicular to the axis of the cone whereby one of the two cuts forms one piston member and the other cut forms the other piston member. Piston member 42 is smaller than piston member 41 by virtue of its near proximity to the apex of the cone. As shown in FIG. 4, the surface 34 is not actually a plane surface but is indented to receive one end of coil spring 33.

The other piston member 41 has external outlines similar to those of member 42, but its parallel plane surfaces are slightly larger in diameter than those of member 42. Also, member 41 is inverted in relationship to member 42 and its centered extension 43 is larger in length than piston member 42.

Both members 41 and 42 have axial centered bores. The bore in member 42 is relatively small in diameter and holds the end of the metering column 31 which passes through the center of the larger opening or center bore of end 26 of flange 25. Rod 30 fits tightly in the center bore or opening 24 of flange 25 with knurled nut and O-ring assembly 28 preventing gasoling from leaking out of opening 27A in flange 25. The center bore of the piston assembly 32 as defined by the surface 44 identified in FIG. 4 has a minimum bore dimension at a point 45 near the flat surface 41A of piston member 41. From point 45 surface 44 diverges outwardly as a substantially conical surface.

Piston members 41 and 42 are secured together with their axes aligned as shown in FIGS. 4 and 6 by means of two screws 46 which pass vertically through both members and through two washers 47 which are positioned between the adjacent surfaces of the two piston members 41 and 42 to cause a separation 48 therebetween. Clearance holes are provided in piston member 42 for screws 46; in piston member 41 tapped holes engage the screws.

The fuel-metering column 31 with apertures 31A positioned therearound is substantially cylindrical except that it may taper down to a reduced diameter toward the end of the metering rod 30, if so desired. Approximately the lower third of the length of column 31 has a cylindrical center bore which is sufficiently larger in diameter than metering rod 30 as to receive rod 30 and allow free longitudinal motion of rod 30 therein.

Figure 3:
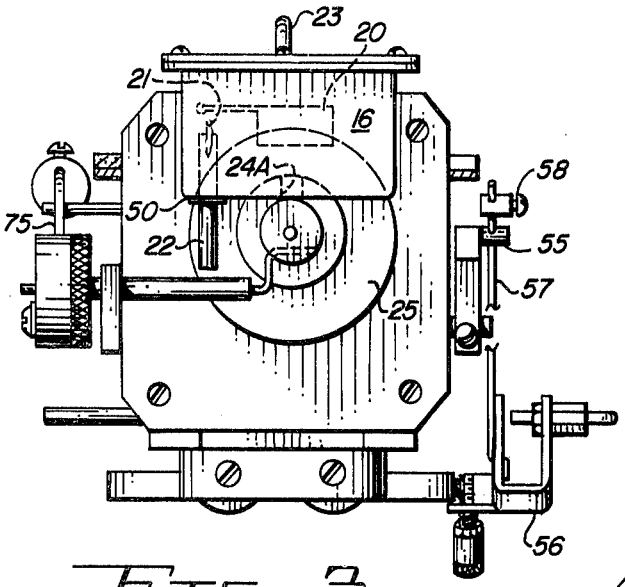
FIG. 3 is a right end view partly broken away of the carburetor shown in FIG. 1.

Opening 24 is integral with reservoir 16 by virtue of a hollow connecting column tube 24A shown in FIG. 3 which opens into reservoir 16 near its bottom.

Reservoir 16, as shown in FIGS. 1 and 3, is in the form of a rectangular box with a flat top cover 49 held in place by suitable screws. A gasket may be employed under the cover with gasoline delivered to reservoir 16 by a fuel pump through fuel inlet 22 which connects to a fitting 50 at the bottom of reservoir 16. Fitting 50 leads upward to a needle valve in the fuel metering column which is operated by float 20, the float 20 and fuel metering column 21 regulating the level of gasoline in reservoir 16. The upper volume of reservoir 16 above the surface of the gasoline is at atmospheric pressure by virtue of vent 23 which is visible in FIGS. 1 and 3.

The inside wall 51 of carburetor housing 11 is in the form of a venturi with a minimum diameter at an area 52 located between the ends of the cylindrical housing. From area 52 wall 51 is divergent outwardly.

The piston assembly 32 may be secured to flange 25 and conical nose configuration 27 prior to final assembly of carburetor 10 by first inserting metering rod 30 through the bore in the flange 25 and conical nose configuration 27. The coil spring 33 is then inserted through the opening 38 of housing 11 and over the end of a thread bolt 53 secured as shown in FIG. 3 to piston member 42 and inside of the end of a metering column 31 which surrounds the metering rod 30 along most of its length. One end of spring 53 is retained by the indented surface of piston member 42 and the other end by flange 35. Piston assembly 12 is secured to metering column 31 by its threaded end 31B. Metering rod 30 is contained within flange 28 by virtue of the containment of the knurled nut and O-ring assembly 29 within the bore of flange 25. Spring 33 is in compression and urges metering column 31 and piston assembly 32 toward the left, as shown in FIG. 4.

Figure 2:
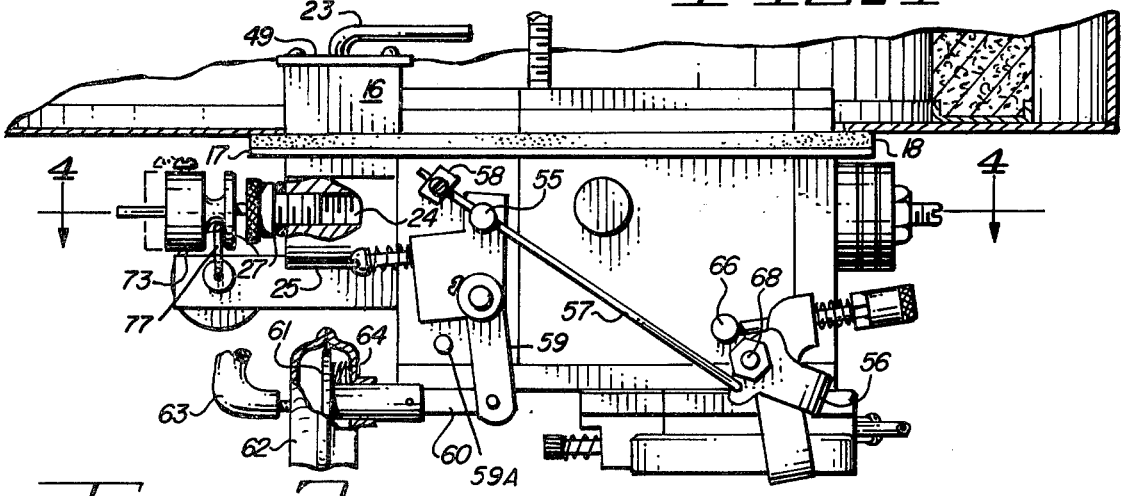
FIG. 2 is a rear side view of the carburetor shown in FIG. 1.

When piston assembly 32 has been thus positioned, the combined assembly is secured together within housing 11 with a lever arm 55 pivotally journaled within one side of housing 11, as shown in FIGS. 2, 3 and 4. This lever arm 55, the free end of which is arranged to engage a ledge 43A forming a part of extension 43, is then coupled at its other end to throttle arm 56 by installing lever 57, as shown in FIG. 2.

A movable collar 58 is mounted on one end of lever 57 to adjustably position through lever 59 the piston rod 60 of a piston or diaphragm 61 of a vacuum diaphragm 62 connected to the carburetor housing by a bracket (not shown). The piston of the vacuum diaphragm is actuated to the left, as shown in FIG. 2, through the action of the vacuum through piping 63 created by the running of an associated internal combustion engine until it engages stop 59A. Pulling action on lever 59 under vacuum action of the engine obtained from the base of the carburetor through piping 63 causes lever 59 to engage stop 59A. This movement of lever 59 controls the position of piston assembly 32 through shaft 55. When the engine is shut off and vacuum is zero piston assembly 32 moves back against O-ring 65 providing positive sealing action of the piston assembly 32 and nose configuration 28. One or more springs 64 biases the piston 61 to the position shown in FIG. 2 to cause or permit the piston assembly 32 and O-ring 65 positioned at the piston end of the piston assembly to tightly engage and stop any further gasoline flow through the metering valve assembly 28 and its surrounding sleeve or column 31.

When the associated internal combustion engine is started and the throttle arm 56 is moved against its pin 66, lever arm 55 is rotated causing it to engage ledge 43A of extension 43 forcing the piston assembly 32 to the right, as shown in FIG. 4, thereby moving the piston assembly away from the end of nose configuration 27 causing gasoline to flow into the manifold through openings 67. In any given implementation of the invention, one or the other of the two springs 64 and the piston 62 may be omitted.

OPERATION

Before the engine operating carburetor 10 is started, piston assembly 32 is held in the fully leftward position shown in FIG. 4 by spring or springs 33 so that the point or end of the conical nose configuration 27 is forced against piston portion 42 with "O-ring" 65 which surrounds rod 30 near its junction with the top surface of piston member 42 and the knurled nut O-ring assembly fitting tightly against the open end of flange 25. Gasoline from reservoir 16 enters the opening 30A in flange 25 through tube 24A under the action of gravity and surrounds rod 30 in metering column 31 all the way down to the lower end of rod 30 where it is blocked from further movement formed by "O-ring" 65.

When piston assembly 32 is in this fully leftward extended position separation 48 between piston members 41 and 42 is at the approximate level of point or area 52 which is at the minimum dimension of venturi surface 51.

As the engine is started and the gas peddle or lever is moved, throttle arm 56 pivots on its axis 68 to open the butterfly valves 70 and simultaneously through the action of levers 57 and 55 the piston assembly 32 is moved to the right as shown in FIG. 4, thereby breaking the seal of "O-ring" 65 on metering rod 30 at the end of the conical nose configuration 27 so that gasoline is admitted from metering column 31 into the interior of piston assembly 32. During engine operation gasoline and its mixture with air are injected into the carburetor, as will be obvious from the following description.

As the engine is turned over by the starter, air is drawn through the air filter assembly 13 and passes downwardly through carburetor 10 into the air intake opening as diagrammatically shown by arrows 71. The bulk of the airflow is through the space surrounding the outer surface of piston assembly 32 and inside venturi surface 51. As the air passes the outermost edge of piston member 41, it experiences an increase in velocity and a corresponding decrease in pressure. The reduction in pressure at the edge of the separation 48 between piston members 41 and 42 promotes air flow through a second path which commences at the left hand end of projection 44A and continues through the passage 72 which is bounded by the inside surface of the opening formed between the outside surface of the conical nose configuration and the inside surface of the bore in piston member 41. The contour of this passage 72 forms a venturi which is adjusted automatically as piston assembly 32 moves to the right as shown in FIG. 4 over the end of metering column 31. As the air flows through this venturi configuration it passes the end of metering column 31 at high velocity and low pressure vaporizing and taking with it the gasoline which is now flowing around metering column 31, through the apertures 31A and also through the inside of this metering column around the metering rod 30.

This rich mixture of air and gasoline passes radially outward through separation 48 to mix again with the main airflow at the peripheries of piston members 41 and 42. At this point of mixture with the main airflow there is a high degree of turbulence owing to the specific construction of the piston members 41 and 42. More particularly, the turbulence is produced by the protrusion of the outer edge of piston member 41 beyond the outer edge of piston member 42 and also by virtue of the sharp conical surfaces of these piston members. The turbulence thus effected produces a thorough mixture of the air and gasoline vapors, such thorough mixing being, of course, highly desirable and essential to the efficient performance of the engine.

As the engine speed picks up, the airflow increases and the reduced air pressure below piston assembly 32 pulls it rightward against the force of springs 53 so that the action of lever 55 is no longer required.

At low engine speeds the downward pull is moderate and piston assembly 32 assumes a position near its limit shown in FIG. 4 where the periphery of piston member 41 is nearly on a level with point or area 52 of surface 51. A minimal space constituting a very small venturi is thus formed at the periphery of assembly 32 so that even at the low volume of airflow prevailing at low engine speeds a high velocity is achieved at this point as required to produce the secondary airflow inside piston assembly 32 and the turbulence at the edges of piston member 41.

As engine speed increases, the increased vacuum to the right of the piston assembly 32, as shown in FIG. 4, pulls it farther to the right so that a larger venturi area is produced around the peripheries of piston members 41 and 42, the larger area accommodating the increased airflow while maintaining the required air velocity past the peripheries of piston members 41 and 42. Also, as assembly 32 moves to the right relative to the lower end of column 54, the effective cross-sectional area of the passage 72 formed is increased as appropriate to accommodate a higher volume of air through the interior of piston assembly 32, the higher volume of airflow through passage 72 being required to deliver an increased amount of gasoline to the engine.

The increased flow of gasoline is also effected by the design of the metering rod 30. When piston assembly 32 is in the left-most position as shown in FIG. 4, the small bore at the lower end of column 72 covers most of the exit opening of metering column 31.

It will be noted that the simultaneous adjustment of both the primary and secondary venturies and the adjustment of the fuel flow are accomplished through the automatic motion of a single part, namely, the piston assembly 32 through adjustment means 73. A bimetallic spring in the manifold of an associated engine (not shown) moves lever 74 and an associated weighted arm 75 away from its stop 76 to rotate a lever 77 which in turn moves adjustment means 73 to control the portion of the piston assembly 32. Thus, automatic choking action of the known type is provided. Furthermore, the only intimate bearing surfaces involved in this motion are those inside metering column 31 which is filled with gasoline, the gasoline effectively cleaning and lubricating the moving parts. This important feature is not provided in the prior art devices.

A significantly improved carburetor is thus disclosed in accordance with the stated objects of the invention, and the shortcomings of the prior art are effectively overcome. Although one embodiment has been illustrated and described, it will be apparent to those skilled in the art that various changes and modifications may be made therein without departing from the spirit of the invention or from the scope of the appended claims.

What is claimed is:

1. A low profile carburetor for mounting on an internal combustion engine comprising:

a housing, a hollow mixing chamber provided within said housing and having a fuel reservoir means mounted on its top at one end of said housing and a fuel-air outlet means mounted at the bottom of the other end of said housing, the interior of said chamber forming a venturi shaped opening positioned longitudinally of said housing tapering from a minimum diameter at a point along its length toward a greater diameter opening at each end of said chamber, piston means movably mounted in said opening for movement longitudinal thereof, said piston means comprising along at least a part of its length a segment of a cone, whereby movement of said piston means within said opening forms a first venturi between its outer periphery and the inside surface of said opening, a needle valve assembly fixedly mounted on said carburetor and forming a fuel inlet means extending longitudinally thereof through a conical configuration and a metering rod arranged therein, said conical configuration defining a reservoir within its larger end for receiving fuel for movement around said metering rod and through said fuel inlet and out the apex of said conical configuration, said metering rod being adjustably mounted on said carburetor and extending from said reservoir through said fuel inlet means toward said piston, said piston means having a hollow extension for movement around and along the outer periphery of the apex end of said conical configuration, the inside surface of said hollow extension forming with the outside surface of said conical configuration a passageway forming a second venturi, biasing means attached to said carburetor and engaging said piston means for biasing said piston means around the apex of said conical configuration, said metering rod controlling the flow of fuel through said fuel inlet means, and air inlet means connected to said first venturi and said passageway, said air inlet means transmitting air into said passageway for mixing with the fuel ejected from said fuel inlet means and separately into said first venturi for mixing air with the fuel and air mixture from said fuel inlet means over at least a part of the outer periphery of said piston means.

2. The low profile carburetor set forth in claim 1 in further combination with:

an O-ring mounted near the apex of said conical configuration for engaging said piston when an associated engine is not running to seal said fuel inlet means.

3. The low profile carburetor set forth in claim 2 in further combination with:

an apertured metering column mounted along the length of said metering rod and attached to and movable with said piston means, and said O-ring being mounted on said metering column near the apex of said conical configuration.

4. The low profile carburetor set forth in claim 2 in further combination with:

lever means connected to the carburetor for biasing said piston against the force of said biasing means during initial starting effort of an associated engine.

5. The low profile carburetor set forth in claim 2 wherein:

said piston comprises a pair of sectors aligned and separated from each other to provide a passageway laterally between the juxtapositioned sectors, said fuel inlet means extends through one of said sectors into said passageway.

6. The low profile carburetor set forth in claim 5 wherein:

said needle valve comprises a rod tapering from a larger diameter size toward a smaller size along at least a part of its length from a point adjacent its fixed end for increasing the fuel inlet discharge capacity under increasing fuel demands.

7. The low profile carburetor set forth in claim 5 in further combination with:

an adjustment means for varying the relative position of said rod within said piston means.

8. The low profile carburetor set forth in claim 7 in further combination with:

a vacuum diaphragm connected to said adjustment means for aiding in causing said needle valve assembly to seal said fuel inlet with said piston means when the associated engine is not running and to aid in opening an associated fuel line when the engine is running.

9. The low profile carburetor set forth in claim 5 in further combination with:

an adjustment means mounted on the outside of said housing actuated by the vacuum created by the associated internal combustion engine and connected to said needle valve assembly for adjustably varying the position of said conical configuration and said metering rod relative to said piston means.

* * * * *